United States Patent [19]

Dolnick

[11] 3,950,795

[45] Apr. 20, 1976

[54] BATHTUB COVER

[75] Inventor: Seymour S. Dolnick, Milwaukee, Wis.

[73] Assignee: Glen Mfg. Inc., Milwaukee, Wis.

[22] Filed: May 9, 1975

[21] Appl. No.: 576,187

[52] U.S. Cl. ..... 4/173 R; 150/52 R

[51] Int. Cl.[2] ..... A47K 3/00; B65B 11/00

[58] Field of Search ..... 4/1, 12, 10, 173, 134, 4/177, 185 R, 185 S, 242, 234; 150/52 R

[56] References Cited

UNITED STATES PATENTS

| | | | |
|---|---|---|---|
| 3,133,292 | 5/1964 | Spier | 4/185 |
| 3,202,193 | 8/1965 | Ware | 150/52 R |
| 3,380,079 | 4/1968 | Dolnick | 4/173 |
| 3,566,414 | 3/1971 | Basner | 150/52 R |

*Primary Examiner*—Henry K. Artis

*Attorney, Agent, or Firm*—Wegner, Stellman, McCord, Wiles & Wood

[57] ABSTRACT

This invention provides a decorative cover for the exposed exterior side of a bathtub, the cover being in the form of decorative material such as a textile, to the back side of which cover is applied a plastic sheet carrying adhesive on each side whereby one side of the sheet is adhesively secured to the back side of the cover and the other side of the sheet may be pressed against the outer wall or side of the bathtub to be adhesively secured thereto.

1 Claim, 5 Drawing Figures

BATHTUB COVER

BACKGROUND OF THE INVENTION

Present day trends in decorating favor a carpeted bathroom and also a built-in tub. In the latter construction, the end walls and at least one side wall of the tub are arranged to merge directly into an enclosure wall while the one side of the tub facing the bathroom is exposed. It is often desirable from a decorator's point of view to cover the exposed side wall of the tub with a fabric material which may either match or be complementary to the carpeting on the floor. Such a construction is illustrated in my earlier U.S. Pat. No. 3,380,079.

The present invention provides a superior manner of securing the decorative cover to the side wall and upper ledge of the tub. The securing means of the present invention is particularly useful where the side wall of the tub is other than purely planar in configuration. Thus, if the side wall is indented or has raised portions for decorative purposes, the present invention provides a cover which is easily secured thereto.

SUMMARY OF THE INVENTION

According to the present invention, I provide a decorative cover for the exposed (bathroom side) side of a bathtub in the form of a textile material, such as chenille, which has a size sufficient to cover the entire exposed side of the bathtub as well as at least a portion of the upper ledge thereof. Covering the entire back side of the cover is a sheet of vapor barrier material such as plastic, with the sheet having a coating of adhesive on each side thereof. One side of the sheet is adhesively secured to the back side of the cover, while the adhesive on the other side of the sheet is covered with a peel-off type of protective film which remains in place until the cover is ready for application. The cover may be cut by the user to the precise size required to cover the exposed side of the bathtub, the protective film removed, and the cover applied directly to the side of the tub. Adherence is excellent and, of course, the decorative value will be appreciated.

DESCRIPTION OF THE PREFERRED EMBODIMENT

Figure 1:
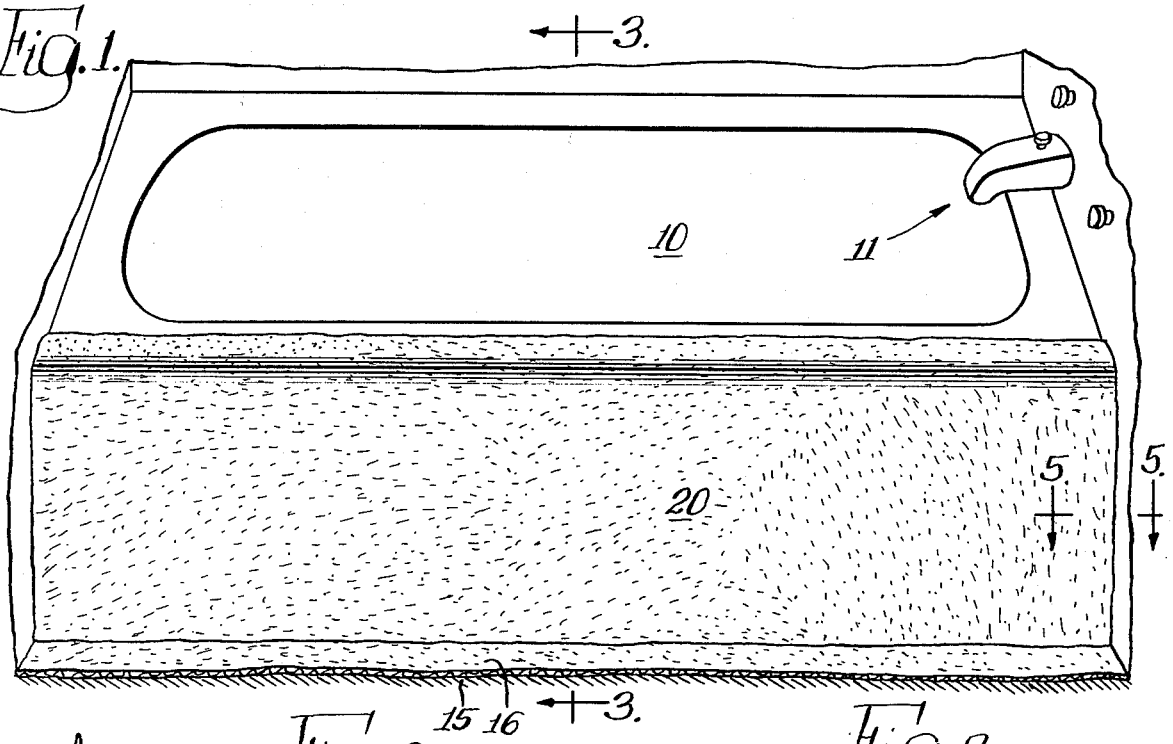
FIG. 1 is a side elevational view of a bathtub including the cover of the present invention.
Figure 2:
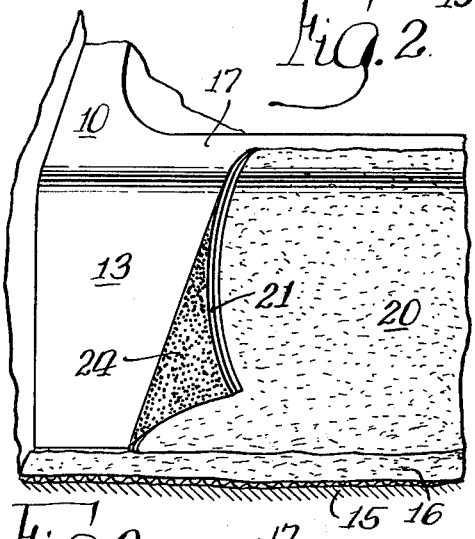
FIG. 2 is a view partially broken away of the lefthand portion of the bathtub showing the cover being applied thereto.
Figure 4:
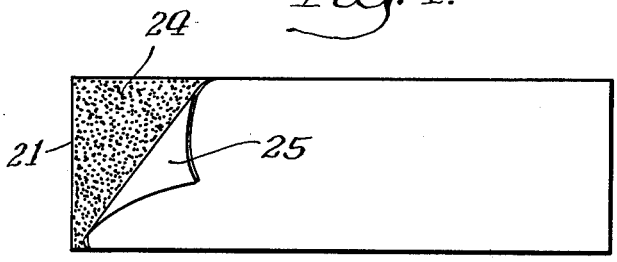
FIG. 4 is a view of the cover showing the protective sheet being partially peeled therefrom.
Figure 5:
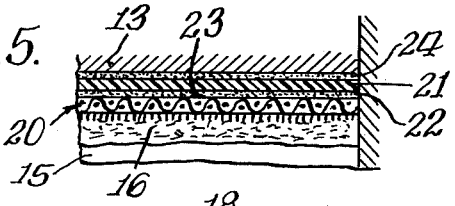
FIG. 5 is a horizontal section along line 5—5 of FIG. 1.
Figure 3:
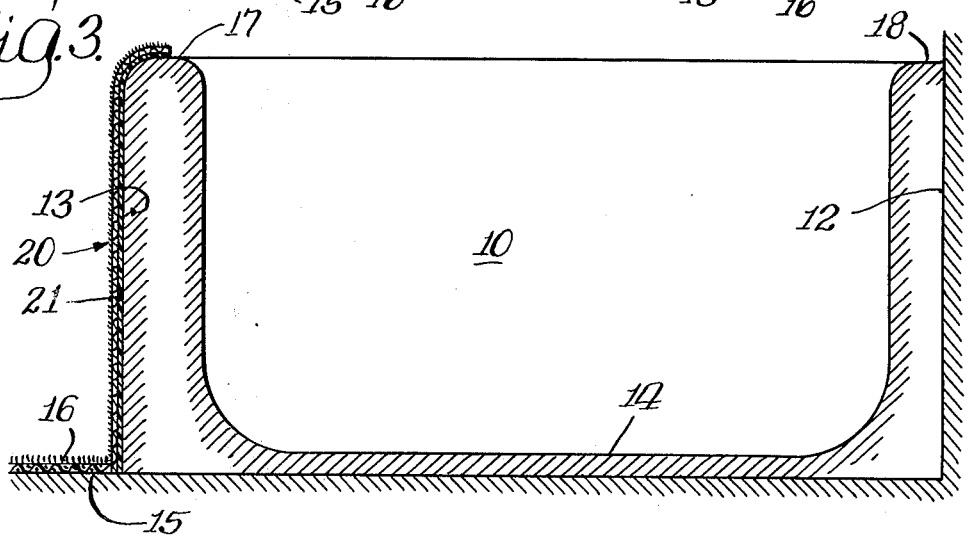
FIG. 3 is a vertical sectional view along line 3—3 of FIG. 1.

Referring now to the drawings, there is shown a bathtub 10 of conventional configuration and equipped with the usual plumbing fixtures 11. The bathtub has outer side walls 12 and 13, with the side wall 12 being closely adjacent the vertical wall surrounding the tub.

The bathroom is shown as having floor 15 covered with a carpet 16 which may terminate at a point closely adjacent the outer side wall 13 of the bathtub. Each of the side walls 12 and 13 has a ledge 17 and 18 at its upper surface.

For covering the exterior face of the side wall 13 there is provided a cover 20, preferably of decorative textile material such as chenille. The cover 20 has a size and shape to fully cover the side wall 13 and at least a portion of the ledge 17. Covering the back side, i.e., the side to be placed adjacent the surface of the side wall 13, of the cover 20, is a sheet 21 of vapor barrier material such as a plastic. A coating of adhesive 22 covers one side of the sheet 21 and is pressed into contact with the back side 23 of the cover 20 so as to be adhesively secured thereto. The other side 24 of the sheet 21 also carries an adhesive coating which is protected prior to installation by a sheet of release material 25.

In utilizing the decorative cover of the present invention, the cover 20 with the double-faced adhesive sheet 21 secured thereto, is cut by the user to the proper size to fit the side wall 13 and to cover as much of the upper ledge 17 as is desired. The sheet 25 is then peeled from the adhesive face 24 and the entire cover is applied against the face and upper ledge of the side wall 13. Variations from a planar configuration on the outer face of the tub are easily accommodated by the material of the cover which is flexible, and secure adhesion is assured even in the presence of such irregularities.

It will be understood that the portion of the cover overlying the ledge 17 provides a seat for the user of the tub when desired, and has a non-skid property which is helpful in preventing accidents when sitting on the edge of the tub or when climbing in or out.

I claim:

1. A decorative cover of the character described for use with a bathtub comprising a piece of textile material corresponding generally to the size of the outer side of the bathtub with the width of said textile material being slightly greater than the height of said side so as to overlie at least a portion of the ledge at the top of said side, a sheet of vapor barrier plastic material adhesively secured to the back side of said cover, said plastic material having a size equal to the size of said textile material, a coating of adhesive on the other side of said sheet of plastic material, and a protective sheet of release material covering said adhesive on said other side said sheet being peelable from said other side to expose said adhesive whereby the latter may be applied to the side wall and ledge of the bathtub adhesively to secure the cover thereto.

* * * * *